US012372075B2

(12) United States Patent
Raktim et al.

(10) Patent No.: US 12,372,075 B2
(45) Date of Patent: Jul. 29, 2025

(54) VALVE PLATE WITH NOTCH ARRANGEMENT FOR FLUID PUMP

(71) Applicant: Danfoss Power Solutions II Technology A/S, Nordborg (DK)

(72) Inventors: Kashyap Suraj Raktim, Pune (IN); Ghambir Shivank, Pune (IN); Salutagi Shivayogi Sidram, Pune (IN); Hande Nitin, Pune (IN)

(73) Assignee: DANFOSS POWER SOLUTIONS II TECHNOLOGY A/S, Nordborg (DK)

( * ) Notice: Subject to any disclaimer, the term of this patent is extended or adjusted under 35 U.S.C. 154(b) by 427 days.

(21) Appl. No.: 17/613,971

(22) PCT Filed: Jun. 26, 2020

(86) PCT No.: PCT/EP2020/025303
§ 371 (c)(1),
(2) Date: Nov. 24, 2021

(87) PCT Pub. No.: WO2020/259869
PCT Pub. Date: Dec. 30, 2020

(65) Prior Publication Data

US 2022/0228580 A1 Jul. 21, 2022

(30) Foreign Application Priority Data

Jun. 26, 2019 (IN) ..... 201911025337

(51) Int. Cl.
*F04B 1/2042* (2020.01)
*F04B 1/2021* (2020.01)

(52) U.S. Cl.
CPC ..... *F04B 1/2042* (2013.01); *F04B 1/2021* (2013.01)

(58) Field of Classification Search
CPC ..... F04B 1/303; F04B 1/2035; F04B 19/22; F04B 1/2021; F04B 1/2042
See application file for complete search history.

(56) References Cited

U.S. PATENT DOCUMENTS 3,006,284 A * 10/1961 Pitt ..... F04B 1/124 92/57
5,230,274 A * 7/1993 Yu ..... F04B 1/2042 91/499

(Continued)

FOREIGN PATENT DOCUMENTS

CH 711662 A1 4/2017
CN 101949373 A 1/2011

(Continued)

OTHER PUBLICATIONS

English Machine Translation of CN-108644104-A (Year: 2018).*

(Continued)

*Primary Examiner* — Nathan C Zollinger
(74) *Attorney, Agent, or Firm* — McCormick, Paulding & Huber PLLC

(57) ABSTRACT

A valve plate for a fluid pump includes a body having a first surface and an oppositely disposed second surface. The body defines a first kidney slot that extends through the first and second surfaces and a second kidney slot that extends through the first and second surfaces. A first notch is disposed in the first surface of the body and extends outwardly from the first kidney slot in a direction toward the second kidney slot. A second notch is disposed in the first surface and extends outwardly from the first kidney slot in a direction toward the second kidney slot. The second notch is separated from the first notch.

27 Claims, 7 Drawing Sheets

(56) References Cited

U.S. PATENT DOCUMENTS

| | | | | |
|---|---|---|---|---|
| 5,593,285 | A | 1/1997 | Watts | |
| 6,024,541 | A | 2/2000 | Perstnev et al. | |
| 10,024,158 | B2 * | 7/2018 | Hofmann | F04B 1/306 |

FOREIGN PATENT DOCUMENTS

| | | | | | |
|---|---|---|---|---|---|
| CN | 103968070 | A | | 8/2014 | |
| CN | 108644104 | A | * | 10/2018 | F04B 53/00 |
| JP | H1077955 | A | * | 3/1998 | |
| JP | H10131843 | A | * | 5/1998 | |
| JP | H10196518 | A | * | 7/1998 | |
| JP | 2000356183 | A | * | 12/2000 | |
| JP | 2001115947 | A | * | 4/2001 | |
| JP | 2006112340 | A | | 4/2006 | |
| JP | 2013-253605 | A | | 12/2013 | |
| JP | 2014145301 | A | * | 8/2014 | A01C 11/006 |
| WO | 2018215514 | A1 | | 11/2018 | |

OTHER PUBLICATIONS

International Search Report for PCT/EP2020/025303 Dated Jul. 21, 2020.

Notice of the Reason for Refusal for Japanese Patent Application No. 2021-571536, dated Feb. 13, 2024 and its English translation.

* cited by examiner

VALVE PLATE WITH NOTCH ARRANGEMENT FOR FLUID PUMP

CROSS-REFERENCE TO RELATED APPLICATION

This application is a National Stage application of International Patent Application No. PCT/EP2020/025303, filed on Jun. 26, 2020, which claims priority to Indian Application No. 201911025337 filed on Jun. 26, 2019, each of which is hereby incorporated by reference in its entirety.

TECHNICAL FIELD

The present disclosure relates to fluid pumps having a rotating group and more particularly to a valve plate for use with such fluid pumps.

BACKGROUND

Valve plates are used in fluid pumps to provide fluid to expanding pumping chambers in the fluid pump and to provide a path for fluid to be discharged from contracting pumping chambers. While valve plates in fluid pumps have been improved over the years, issues have persisted with regard to noise and damage due to cavitation.

SUMMARY

An aspect of the present disclosure relates to a valve plate for a fluid pump. The valve plate includes a body having a first surface and an oppositely disposed second surface. The body defines a first kidney slot that extends through the first and second surfaces and a second kidney slot that extends through the first and second surfaces. A first notch is disposed in the first surface of the body and extends outwardly from the first kidney slot in a direction toward the second kidney slot. A second notch is disposed in the first surface and extends outwardly from the first kidney slot in a direction toward the second kidney slot. The second notch is separated from the first notch.

Another aspect of the present disclosure relates to a fluid pump. The fluid pump includes a barrel that defines a plurality of cylinder bores and a plurality of fluid passages in fluid communication with the plurality of cylinder bores. A plurality of pistons is disposed in the plurality of cylinder bores. The pistons are adapted to reciprocate in the cylinder bores. A valve plate is in fluid communication with the barrel. The valve plate includes a first kidney slot having a first end and a second end, a second kidney slot having a first end and a second end. The second kidney slot is disposed in the body so that the second end of the second kidney slot is adjacent to the first end of the first kidney slot. A first notch I extends outwardly from the first end of the first kidney slot. A second notch extends outwardly from the first end of the first kidney slot. The first notch is separated from the second notch. A length of the first notch is greater than a length of the second notch.

Another aspect of the present disclosure relates to a fluid pump. The fluid pump includes a barrel that defines a plurality of cylinder bores and a plurality of fluid passages in fluid communication with the plurality of cylinder bores. A plurality of pistons is disposed in the plurality of cylinder bores. The pistons are adapted to reciprocate in the cylinder bores. A valve plate is in fluid communication with the barrel. The valve plate includes a first kidney slot in intermittent fluid communication with the plurality of fluid passages and a second kidney slot in intermittent fluid communication with the plurality of fluid passages. A transition land is disposed between the first and second kidney slots. A first notch extends outwardly from the first kidney slot into the transition land. A second notch extends outwardly from the first kidney slot in the transition land. The second notch is separated from the first notch.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
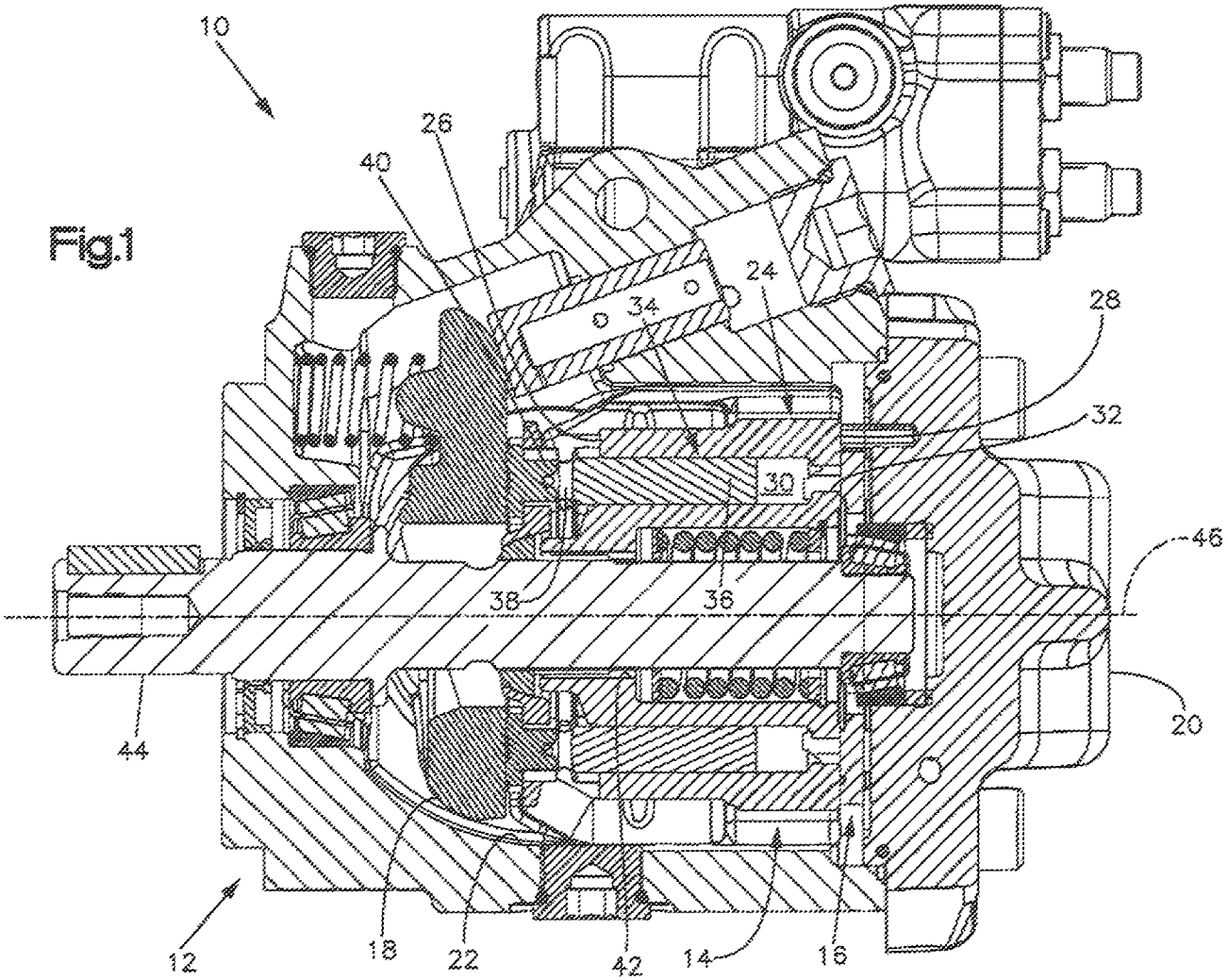
FIG. 1 is a cross-sectional view of a fluid pump having exemplary features of aspects in accordance with the principles of the present disclosure.

Referring now to FIG. 1, a fluid pump 10 is shown. In the depicted embodiment, the fluid pump 10 includes a pump housing 12, a rotating group 14, a valve plate 16, a swashplate 18 and an endcap 20.

The pump housing 12 of the fluid pump 10 defines a pumping chamber 22. In the depicted embodiment, the rotating group 14 is disposed in the pumping chamber 22.

The rotating group 14 includes a barrel 24 having a first end 26 and an oppositely disposed second end 28. The barrel 24 defines a plurality of cylinder bores 30 that extend through the first end 26 of the barrel 24. The barrel 24 further defines a plurality of fluid passages 32 that extend through the second end 28 of the barrel 24 and are in fluid communication with the cylinder bores 30 so that each fluid passage 32 is in fluid communication with a corresponding cylinder bore 30.

The rotating group 14 further includes a plurality of pistons 34. Each piston 34 includes a first axial end portion 36 and an oppositely disposed second axial end portion 38. The first axial end portions 36 of the pistons 34 are disposed in the cylinder bores 30. The second axial end portions 38 of the pistons 34 are disposed in contact with slippers 40. When an angle of the swashplate 18 is greater than zero, the pistons 34 are adapted to reciprocate in the cylinder bores 30 as the barrel 24 rotates. The slippers 40 slide across a surface of the swashplate 18 as the barrel 24 rotates.

In the depicted embodiment, a central bore 42 of the barrel 24 is engaged with an input shaft 44. In the depicted embodiment, the central bore 42 of the barrel 24 is in splined engagement with the input shaft 44. In a pumping mode, the rotating group 14 rotates about a central axis 46 in response to rotation of the input shaft 44.

The fluid pump 10 defines a fluid inlet and a fluid outlet (not shown). In the one embodiment, the endcap 20 defines the fluid inlet and outlet. The fluid inlet and outlet are in fluid communication with the cylinder bores 30 of the rotating group 14 through the valve plate 16, which is stationary in the depicted embodiment. When an angle of the swashplate 18 is greater than zero, fluid enters the expanding cylinder bores 30 from the fluid inlet, through the valve plate 16, and into the fluid passages 32 corresponding to the expanding cylinder bores 30 in response to rotation of the input shaft 44. Fluid is discharged from the contracting cylinder bores 30 through the corresponding fluid passages, the valve plate 16 and through the fluid outlet as the input shaft 44 rotates.

Figure 2:
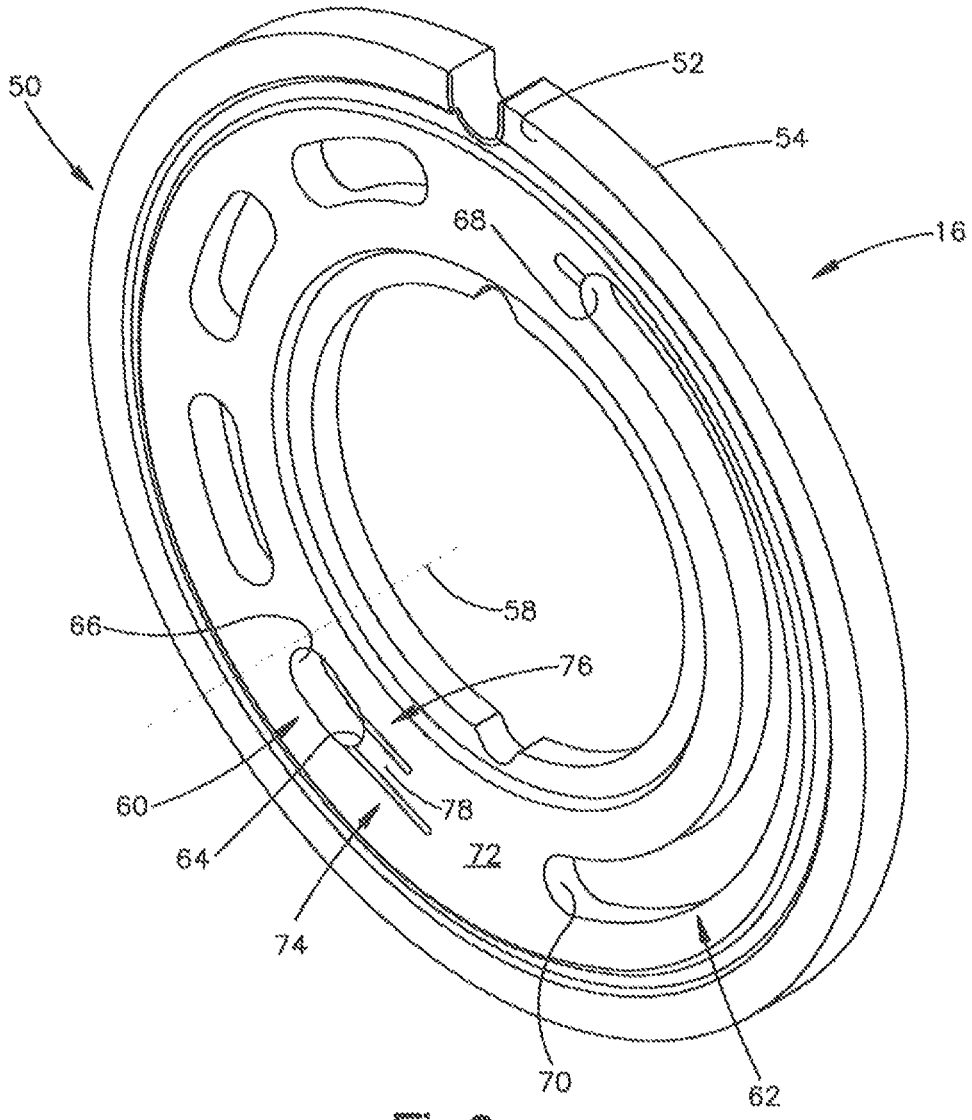
FIG. 2 is an isometric view of a valve plate suitable for use with the fluid pump of FIG. 1.
Figure 3:
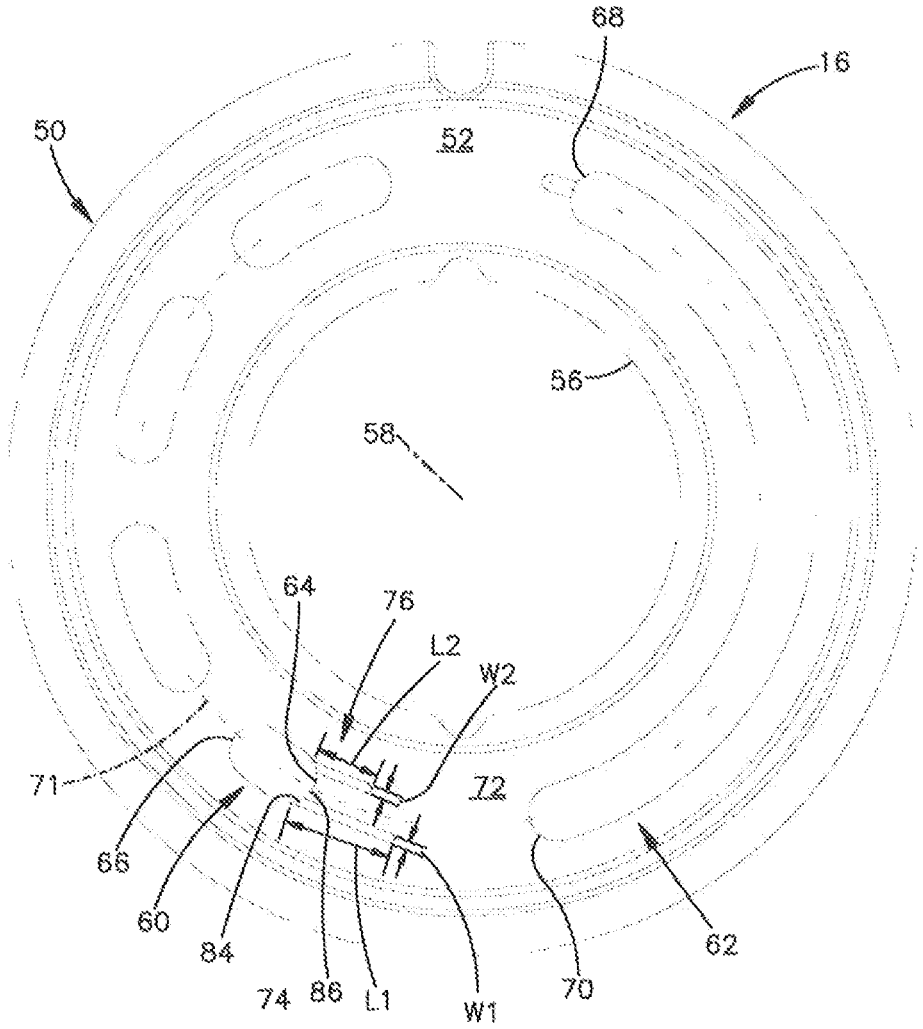
FIG. 3 is a front view of the valve plate of FIG. 2.

Referring now to FIGS. 2 and 3, the valve plate 16 is shown. The valve plate 16 includes a body 50. The body 50 includes a first surface 52 and an oppositely disposed second surface 54. The body 50 defines a central opening 56 that extends through the first and second surfaces 52, 54. The central opening 56 defines a center axis 58. When the valve plate 16 is disposed in the fluid pump 10, the center axis 58 of the valve plate 16 is generally aligned with the central axis 46.

The body 50 of the valve plate 16 further defines a first kidney slot 60 and a second kidney slot 62. The first and second kidney slots 60, 62 extend through the first and second surfaces 52, 54 of the body 50. In the depicted embodiment, the first and second kidney slots 60, 62 are generally arcuate in shape.

The first kidney slot 60 includes a first end 64 and an oppositely dispose second end 66. The second kidney slot 62 includes a first end 68 and an oppositely disposed second end 70. The body 50 includes a circumferential reference 71. The circumferential reference 71 bisects the first and second ends 64, 66 of the first kidney slot 60 and the first and second ends 68, 70 of the second kidney slot 62 so that the circumferential reference 71 passes through the center of the first and second kidney slots 60, 62. The first and second kidney slots 60, 62 are disposed on the circumferential reference 71 about the center axis 58 of the valve plate 16.

The first and second kidney slots 60, 62 are generally adjacent to each other. In the depicted embodiment, the first end 64 of the first kidney slot 60 is disposed adjacent the second end 70 of the second kidney slot 62.

The first kidney slot 60 is in fluid communication with one of the fluid inlet and the fluid outlet while the second kidney slot 62 is in fluid communication with the other of the fluid inlet and the fluid outlet. In the preferred embodiment, the first kidney slot 60 is in fluid communication with the fluid outlet while the second kidney slot 62 is in fluid communication with the fluid inlet.

In the one embodiment, the first kidney slot 60 includes a plurality of kidney slots. In the depicted embodiment, the first kidney slot 60 includes four kidney slots.

As the rotating group 14 rotates in response to rotation of the input shaft 44 when the swashplate 18 is disposed at an angle greater than zero, the fluid passages 32 of the barrel 24 slide across the first surface 52 of the valve plate 16 so that fluid passages 32 are in fluid communication with the first kidney slot 60 as the pistons 34 retract in the cylinder bores 30 and in fluid communication with the second kidney slot 62 as the pistons 34 extend from the cylinder bores 30. The first kidney slot 60 is separated from the second kidney slot 62 by a transition land 72. The transition land 72 is disposed at a location on the first surface 52 of the valve plate 16 where the pistons 34 are transitioning between extending and retracting.

The body 50 of the valve plate 16 further defines a first notch 74 and a second notch 76. The first and second notches 74, 76 are disposed on the first surface 52 of the valve plate 16 and are in fluid communication with the first kidney slot 60. The first and second notches 74, 76 are configured to reduce noise in the fluid pump 10 and to reduce the likelihood of erosion due to cavitation in the first surface 52 of the valve plate 16.

The first notch 74 extends outwardly from the first kidney slot 60 in a direction toward the second kidney slot 62. It will be understood that the phrase "toward the second kidney slot 62" in reference to the first notch 74 as used herein and in the claims is in a direction such that the first notch 74 overlaps a portion of the fluid passages 32 of the barrel 24 as the barrel 24 rotates and as those fluid passages 32 pass through the transition land 64 thereby establishing intermittent fluid communication between the first notch 74 and the fluid passages 32.

In the depicted embodiment, the first notch 74 extends linearly outwardly from the first kidney slot 60. In other embodiments, the first notch 74 is arcuate in shape. In the depicted embodiment, the first notch 74 extends outwardly from the first kidney slot 60 by a length LI. In one embodiment, the first notch 74 is a U-shaped notch. In another embodiment, the first notch 74 is a V-shaped notch. The first notch 74 has a width WI.

The second notch 76 extends outwardly from the first kidney slot 60 in a direction toward the second kidney slot 62. In the depicted embodiment, the second notch 76 extends linearly outward from the first kidney slot 60. In other embodiments, the second notch 76 is arcuate in shape. It will be understood that the phrase "toward the second kidney slot 62" in reference to the second notch 76 as used herein and in the claims is in a direction such that the second notch 76 overlaps a portion of the fluid passages 32 of the barrel 24 as the barrel 24 rotates and as those fluid passages 32 pass through the transition land 72 thereby establishing intermittent fluid communication between the second notch 76 and the fluid passages 32.

The second notch 76 extends outwardly from the first kidney slot 60 by a length L2. In one embodiment, the second notch 76 is a U-shaped notch. In another embodiment, the second notch 76 is a V-shaped notch. The second notch 76 has a width W2.

In the depicted embodiment, the length LI of the first notch 74 is greater than the length L2 of the second notch 76. In the depicted embodiment, the width WI of the first notch 74 is greater than the width W2 of the second notch 76.

The second notch 76 is separate and distinct from the first notch 74. The second notch 76 is separated from the first notch 74 by a portion 78 of the first surface 52 of the valve plate 16 so that the portion 78 of the first surface 52 is disposed between the first and second notches 74, 76. The first and second notches 74, 76 extend outwardly from the first kidney slot 60 into the transition land 72.

In the depicted embodiment, the first notch 74 extends outwardly from an outer portion 84 of the first end 64 of the first kidney slot 60. The second notch 76 extends outwardly from an inner portion 86 of the first end 64 of the first kidney slot 60. The outer portion 84 of the first end 64 of the first kidney slot 60 is disposed outside of the circumferential radius 71 while the inner portion 86 of the first end 64 of the first kidney slot 60 is disposed inside the circumferential reference 71 so that a distance from the center axis 58 to the outer portion 84 of the first end 64 of the first kidney slot 60 is greater than a distance from the center axis 58 to the inner portion 86 of the first end 64.

Figure 4:
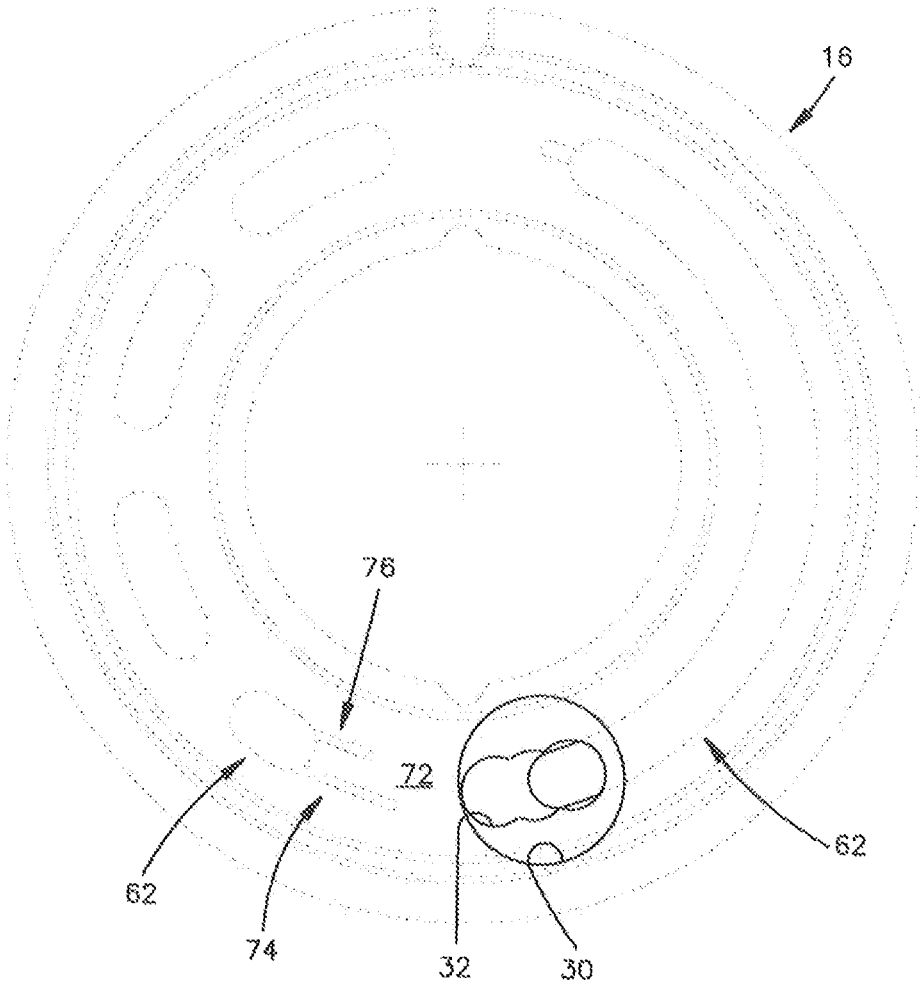
FIG. 4 is a front view of the valve plate showing the interface between a single fluid passage of a barrel of the fluid pump and the valve plate.
Figure 5:
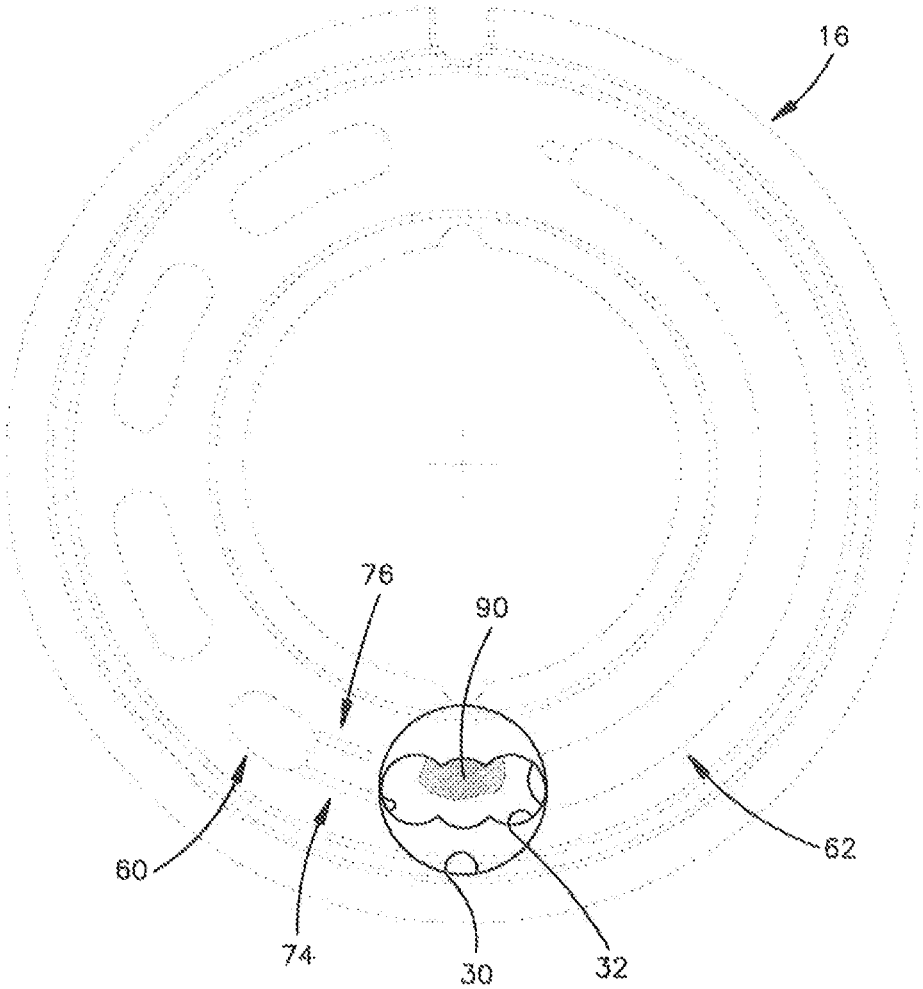
FIG. 5 is a front view of the valve plate showing the interface between a single fluid passage of a barrel of the fluid pump and the valve plate with the barrel in an advanced rotational position.
Figure 6:
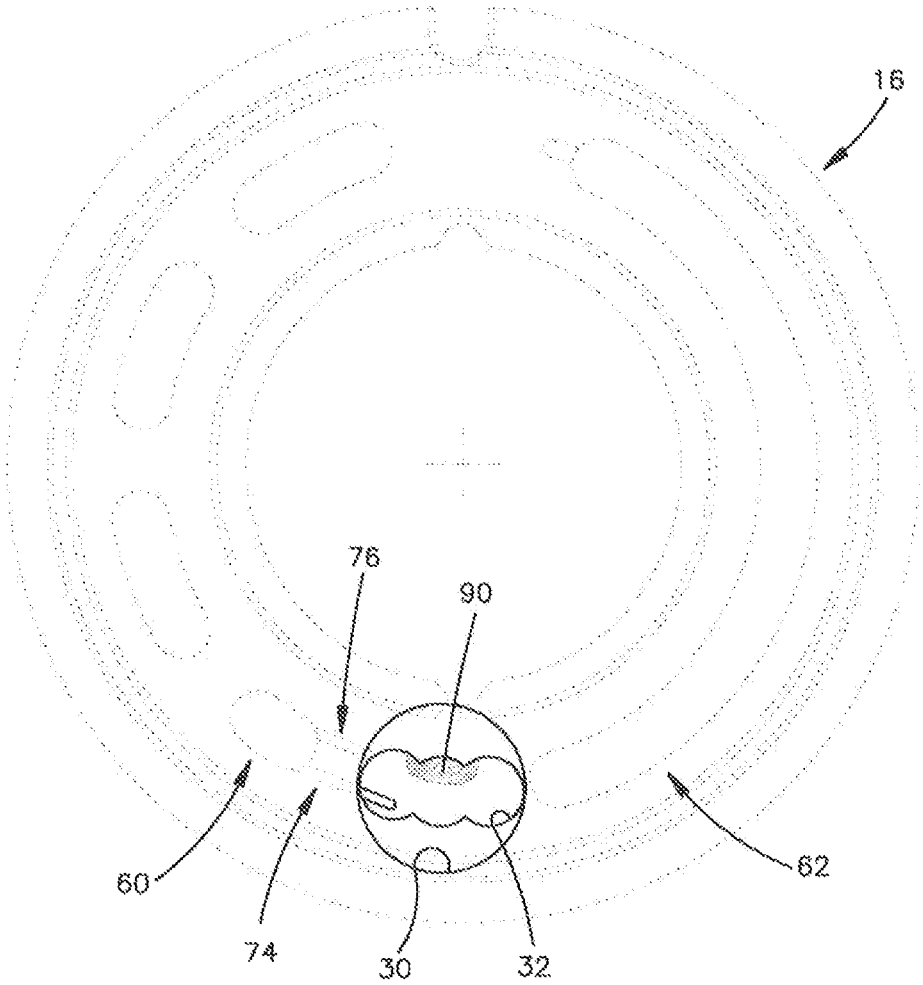
FIG. 6 is a front view of the valve plate showing the interface between a single fluid passage of a barrel of the fluid pump and the valve plate with the barrel in an advanced rotational position.

Referring now to FIGS. 1 and 4-6, the operation of the fluid pump 10 will be described. As previously provided, the input shaft 44 rotates causing the rotating group 14 to rotate. As the rotating group 14 rotates, fluid enters the cylinder bores 30 through the interface between the fluid passages 32 of the barrel 24 and the second kidney slot 62. Fluid is discharged from the cylinder bores 30 through the interface between the fluid passages 32 of the barrel 24 and the first kidney slot 60. FIGS. 4-6 show the interface between one of the plurality of fluid passages 32 and the first and second kidney slots 60, 62 as the fluid passage 32 passes through the transition land 72.

Referring now to FIG. 4, the fluid passage 32 is shown in fluid communication with the second kidney slot 62. In FIG. 5, the barrel 24 is shown in a position in which the fluid passage 32 is in the transition land 72. In the transition land 72, the fluid passage 32 ceases fluid communication with the second kidney slot 62. As the barrel 24 rotates, a low-pressure area 90 forms in an inner diameter portion of the fluid passage 32. This low-pressure area 90 is formed in part due to centrifugal forces, which are caused by the rotation of the barrel 24, acting on the fluid in the fluid passage 32. High-velocity fluid entering the fluid passage 32 at the interface between the first notch 74 and the fluid passage 32 also contributes to the low-pressure area 90. The centrifugal forces redistribute the fluid toward the outer diameter portion of the fluid passage 32 causing the pressure of the fluid at the inner diameter portion of the fluid passage 32 to drop. When the pressure of the fluid in the low-pressure area 90 drops below the vapor pressure of the fluid, vapor bubbles are formed in the fluid.

In the position shown in FIG. 6, the outer diameter portion of the fluid passage 32 is in fluid communication with the first notch 74. This fluid communication between the first notch 74 and the fluid passage 32 is adapted to provide a controlled rise rate in the pressure of the fluid in the fluid passage 32. This controlled rise rate in pressure in the fluid passage 32 reduces noise in the fluid pump I0.

Figure 7:
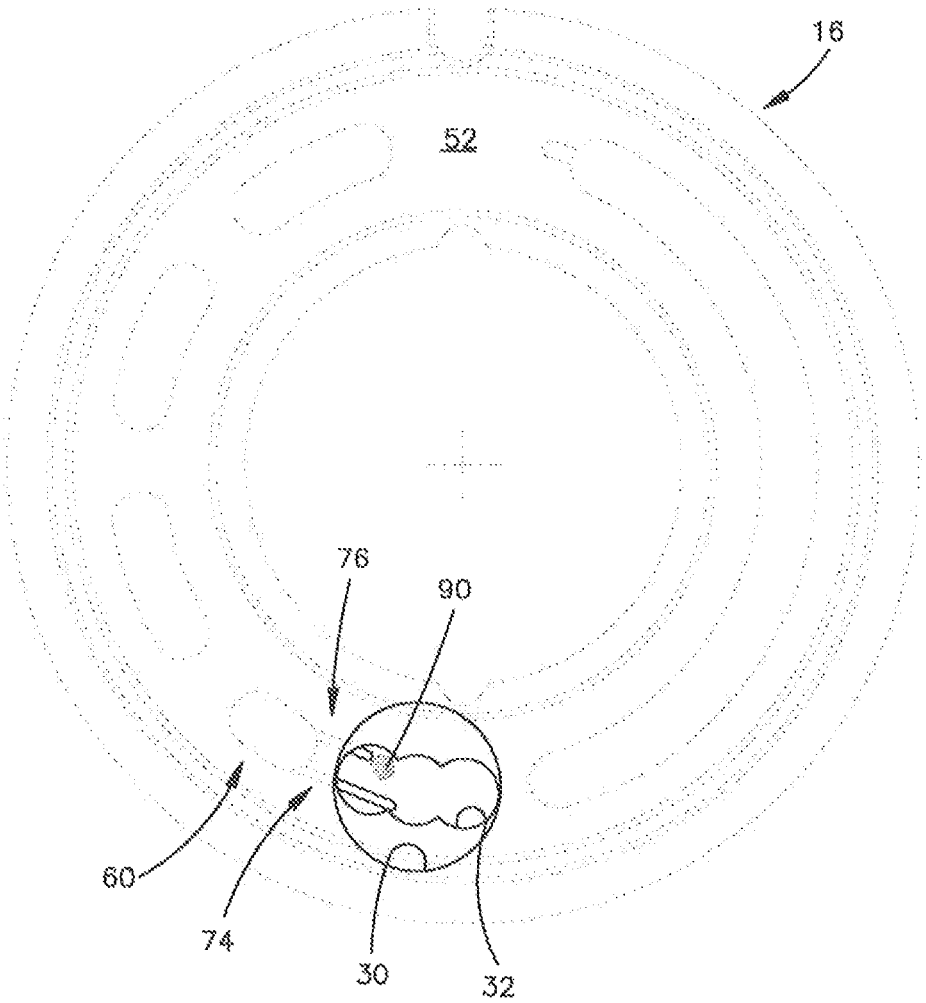
FIG. 7 is a front view of the valve plate showing the interface between a single fluid passage of a barrel of the fluid pump and the valve plate with the barrel in an advanced rotational position.

Referring now to FIG. 7, as the fluid passage 32 continues passing through the transition land 72, the inner diameter portion of the fluid passage 32 comes into fluid communication with the second notch 76 while the outer diameter portion of the fluid passage 32 maintains fluid communication with the first notch 74. In one embodiment, the length L2 of the second notch 76 is less than the length LI of the first notch 74. In one embodiment, the fluid passage 32 doesn't begin fluid communication with the second notch 76 until the piston 34 starts to retract in the bore 30. The retraction of the piston 34 in the bore 30 and the controlled introduction of fluid into the fluid passage 32 through the second notch 76 gradually increases the fluid pressure in the low-pressure area 90 of the fluid passage 32. This gradual increase in fluid collapses the vapor bubbles at a reduced collapse rate, which reduces the likelihood of erosion on the first surface 52 of the valve plate 16.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A valve plate of a fluid pump comprising:
- a body having a first surface and an oppositely disposed second surface, the body defining:
  - a first kidney slot extending through the first and second surfaces;
  - a second kidney slot extending through the first and second surfaces;
  - and a plurality of notches including:
  - a first notch disposed in the first surface of the body, the first notch contacting the first kidney slot and extending outwardly from the first kidney slot in a direction toward the second kidney slot, the first notch having a first notch distal end; and
  - a second notch disposed in the first surface extending outwardly from the first kidney slot in a direction toward the second kidney slot, the second notch having a second notch distal end, wherein the second notch is separated from the first notch;
  - wherein the first notch is disposed the most radially outward of the plurality of notches with respect to a central axis of the valve plate; and
  - wherein a radial extending from the central axis of the valve plate and aligned with the first notch distal end is closer to a radial extending from the central axis of the valve plate and aligned with an end of the second kidney slot than a radial extending from the central axis of the valve plate and aligned with the second notch distal end.

2. The valve plate of claim 1, wherein a length of the first notch is greater than a length of the second notch.

3. The valve plate of claim 2, wherein a width of the first notch is greater than a width of the second notch.

4. The valve plate of claim 1, wherein the first kidney slot includes a first end and an oppositely disposed second end.

5. The valve plate of claim 4, wherein the first notch extends outwardly from an outer diameter portion of the first end of the first kidney slot.

6. The valve plate of claim 5, wherein the second notch extends outwardly from an inner diameter portion of the first end of the first kidney slot, wherein the inner diameter portion of the first end of the first kidney slot is disposed radially closer to a central axis of the valve plate than the outer diameter portion of the first end of the first kidney slot.

7. The valve plate of claim 1, wherein the first and second notches are separated by a portion of the first surface of the body.

8. The valve plate of claim 1, wherein the second notch is disposed the most radially inward of the plurality of notches with respect to the central axis of the valve plate.

9. A fluid pump comprising:
- a barrel defining a plurality of cylinder bores and a plurality of fluid passages in fluid communication with the plurality of cylinder bores;
- a plurality of pistons disposed in the plurality of cylinder bores, the pistons being adapted to reciprocate in the cylinder bores;
- a valve plate in fluid communication with the barrel, the valve plate including:
  - a body defining:
  - a first kidney slot having a first end and a second end;
  - a second kidney slot having a first end and a second end, the second kidney slot being disposed in the body so that the second end of the second kidney slot is adjacent to the first end of the first kidney slot; and
  - a plurality of notches including:
  - a first notch contacting the first kidney slot and extending outwardly from the first end of the first kidney slot; and a second notch extending outwardly from the first end of the first kidney slot, the first notch being separated from the second notch, wherein a length of the first notch is greater than a length of the second notch;

wherein the first notch is disposed the most radially outward of the plurality of notches with respect to a central axis of the valve plate;

wherein the first notch and the second notch are configured such that the first notch comes into fluid communication with a first fluid passage of the plurality of fluid passages prior to the second notch coming into fluid communication with the first fluid passage.

10. The fluid pump of claim 9, wherein the first and second kidney slots are separated by a transition land.

11. The fluid pump of claim 10, wherein the first and second notches are separated by a portion of the transition land.

12. The fluid pump of claim 9, wherein a width of the first notch is greater than a width of the second notch.

13. The fluid pump of claim 9, wherein the first notch extends outwardly from an outer diameter portion of the first end of the first kidney slot.

14. The fluid pump of claim 13, wherein the second notch extends outwardly from an inner diameter portion of the first end of the first kidney slot, wherein the inner diameter portion of the first end of the first kidney slot is disposed radially closer to a central axis of the valve plate than the outer diameter portion of the first end of the first kidney slot.

15. The fluid pump of claim 9, wherein the first kidney slot is configured to discharge fluid from a fluid outlet of each cylinder bore and the second kidney slot is configured to introduce fluid into a fluid inlet of each cylinder bore.

16. The fluid pump of claim 9, wherein the second notch is configured to first come into fluid communication with the first fluid passage when the piston associated with the first fluid passage starts to retract in the associated cylinder bore.

17. The fluid pump of claim 9, wherein the second notch is disposed the most radially inward of the plurality of notches with respect to the central axis of the valve plate.

18. A fluid pump comprising:

a barrel defining a plurality of cylinder bores and a plurality of fluid passages in fluid communication with the plurality of cylinder bores;

a plurality of pistons disposed in the plurality of cylinder bores, the pistons being adapted to reciprocate in the cylinder bores;

a valve plate in fluid communication with the barrel, the valve plate including:

a first kidney slot in intermittent fluid communication with the plurality of fluid passages;

a second kidney slot in intermittent fluid communication with the plurality of fluid passages;

a transition land disposed between the first and second kidney slots; and a plurality of notches including:

a first notch contacting the first kidney slot and extending outwardly from the first kidney slot into the transition land; and a second notch extending outwardly from the first kidney slot into the transition land, the second notch being separated from the first notch;

wherein the first notch is disposed the most radially outward of the plurality of notches with respect to a central axis of the valve plate; and wherein the first notch and the second notch are configured such that the first notch comes into fluid communication with a first fluid passage of the plurality of fluid passages prior to the second notch coming into fluid communication with the first fluid passage.

19. The fluid pump of claim 18, wherein a length of the first notch is greater than a length of the second notch.

20. The fluid pump of claim 19, wherein a width of the first notch is greater than a width of the second notch.

21. The fluid pump of claim 18, wherein a portion of the transition land is disposed between the first and second notches.

22. The fluid pump of claim 18, wherein the first notch extends outwardly from an outer diameter portion of a first end of the first kidney slot.

23. The fluid pump of claim 22, wherein the second notch extends outwardly from an inner diameter portion of the first end of the first kidney slot.

24. The fluid pump of claim 18, wherein the first notch is in intermittent fluid communication with outer portions of the fluid passages and the second notch is in intermittent fluid communication with inner portions of the fluid passages.

25. The fluid pump of claim 18, wherein the first kidney slot is configured to discharge fluid from a fluid outlet of each cylinder bore and the second kidney slot is configured to introduce fluid into a fluid inlet of each cylinder bore.

26. The fluid pump of claim 18, wherein the second notch is configured to first come into fluid communication with the first fluid passage when the piston associated with the first fluid passage starts to retract in the associated cylinder bore.

27. The fluid pump of claim 18, wherein the second notch is disposed the most radially inward of the plurality of notches with respect to the central axis of the valve plate.

* * * * *